US005406718A

United States Patent [19]

Stein

[11] Patent Number: 5,406,718

[45] Date of Patent: Apr. 18, 1995

[54] METHOD AND APPARATUS FOR DRYING PARTICULATE MATERIAL

[75] Inventor: Peter Stein, Caracas, Venezuela

[73] Assignee: GRANA, Inc., New York, N.Y.

[21] Appl. No.: 177,015

[22] Filed: Jan. 4, 1994

[51] Int. Cl.[6] ..... F26B 3/08

[52] U.S. Cl. ..... 34/362; 34/370; 34/589; 34/594; 422/141

[58] Field of Search ..... 34/370, 361, 362, 587, 34/579, 589, 594, 406, 403, 168, 171, 178; 110/245; 432/58; 122/4 D; 422/139, 141, 143; 165/104.16

[56] References Cited

U.S. PATENT DOCUMENTS 2,684,124 7/1954 Hines, Jr. ..... 34/362
3,360,867 1/1968 Sanderson ..... 34/362
4,167,819 9/1979 Ebeling, Jr. et al. ..... 34/362

*Primary Examiner*—Denise L. Gromada
*Attorney, Agent, or Firm*—Cooper & Dunham

[57] ABSTRACT

The present invention relates to a method and apparatus for drying particulate materials such as seeds and grains in which an air dryer having at least one drying stage is accompanied by means to create an upwardly vertical air flow having a velocity in the mesh openings at least equal or larger than the suspension speed of the particles to be dried so that they are temporarily suspended until enough accumulate to provide sufficient weight or downward pressure for the particles to overcome the upward air flow, pass downward through one or more mesh screens and reach the bottom of the dryer. The present invention also relates to a method and apparatus for effecting chemical and/or physical reactions.

7 Claims, 5 Drawing Sheets

METHOD AND APPARATUS FOR DRYING PARTICULATE MATERIAL

BACKGROUND OF THE INVENTION

The present invention relates to a method and apparatus for drying materials, particularly seeds and grains, by introducing the material at the top of an upwardly vertical air flow arrangement.

The present invention also relates to a method and apparatus for effecting chemical and/or physical reactions by means of solid/gas contact. The present invention has application to oxidation reactions, water/gas reactions, ammonia or methanol synthesis reactions, gas or liquid absorption reactions, and removal of $NO_x$ from flue gases.

In certain industries there is a need to dry large amounts of particle formed materials such as seeds and grains. In the past, various methods have been used which require relatively high investment and space. Moreover, in most systems, the seeds may get damaged in the drying process.

It is therefore an object of the present invention to provide an improved method and apparatus for drying of particle formed materials such as seeds and grains.

SUMMARY OF THE INVENTION

For the purpose of attaining the object mentioned above, the present invention provides an apparatus for drying particle formed materials such as seeds and grains, comprising a housing having a top, bottom and side walls, means for introducing materials to be dried into the housing, at least one drying stage having mesh means defining openings greater than the largest size particle of the material to be dried, the drying stage located between the top and bottom walls and extending to the side walls of the housing, means for introducing air into each drying stage, air flow means for creating an upwardly vertical flow of air within the housing having a velocity within the mesh openings at least equal to the speed at which the material to be dried remains suspended, whereby material to be dried will remain suspended until enough particles accumulate above the mesh means to provide sufficient weight or downward pressure for the particles to overcome the upward air flow, pass through the openings in the mesh means and fall downwardly toward the bottom of the housing.

The present invention also provides a method for drying particle formed materials such as seeds and grains comprising the steps of loading particle formed materials to be dried into the top of a housing of a dryer having a top, bottom and side walls, and at least one drying stage having a mesh means defining openings greater than the largest size particles to be dried, the mesh means located between the top and bottom walls and extending to the side walls of the housing, introducing air into each drying stage and creating an upward air flow in the housing have a velocity in the mesh openings at least equal to the suspension speed of materials to be dried, whereby particles to be dried will remain suspended until enough particles accumulate above the mesh means to provide sufficient weight or downward pressure for the particles to overcome the upward air flow, pass through the openings in the mesh means and fall downwardly toward the bottom of the housing.

The present invention also provides an apparatus for effecting chemical and/or physical reactions by means of a solid/gas contact comprising a housing having a top, bottom and substantially parallel side walls and defining an interior having a substantially uniform cross-section in the vertical direction, means for introducing solid materials having a defined particle size into said housing, at least one interaction stage having mesh means defining openings slightly greater than the particle size of the material, said interaction stage located between the top and bottom walls and extending to the side walls of said housing, gas flow means for extracting gas from the top of said housing and for creating a subatmospheric pressure and a rotating and upwardly vertical flow of gas within said housing having a velocity within the mesh openings at least equal to the speed at which the material remains suspended, and for suspending the particles above the mesh means until enough particles accumulate above the mesh means to provide sufficient weight or downward pressure for the particles to overcome the upward gas flow, pass through the openings in the mesh means and fall to the bottom of said housing.

The present invention also provides a method for effecting chemical and/or physical reactions by means of a solid/gas contact comprising loading particle formed solid materials having a defined particle size into the top of a housing having a top, bottom and substantially parallel side walls to define an interior having a substantially uniform cross-section in the vertical direction, and at least one interaction stage having a mesh means defining openings slightly greater than the particle size of the material, said interaction stage located between the top and bottom walls and extending to the side walls of the housing, and extracting gas from the top of the housing and for creating a subatmosphere pressure and a rotating and an upward gas flow in said housing having a velocity within the mesh openings at least equal to the suspension speed of particles, to suspend the particles until enough particles accumulate above the mesh means to provide sufficient weight or downward pressure for the particles to overcome the upward gas flow, pass through the openings in the mesh means and fall to the bottom of said housing.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

DETAILED DESCRIPTION OF THE PREFERRED EMBODIMENT

A preferred embodiment of a dryer 10 according to the invention will be described with reference to FIGS. 1–3, which show a seed or grain dryer having a plurality of drying stages defined by a corresponding plurality of mesh screens. However, the invention is not limited to seed or grain drying, or to the particular embodiment described.

Figure 1:
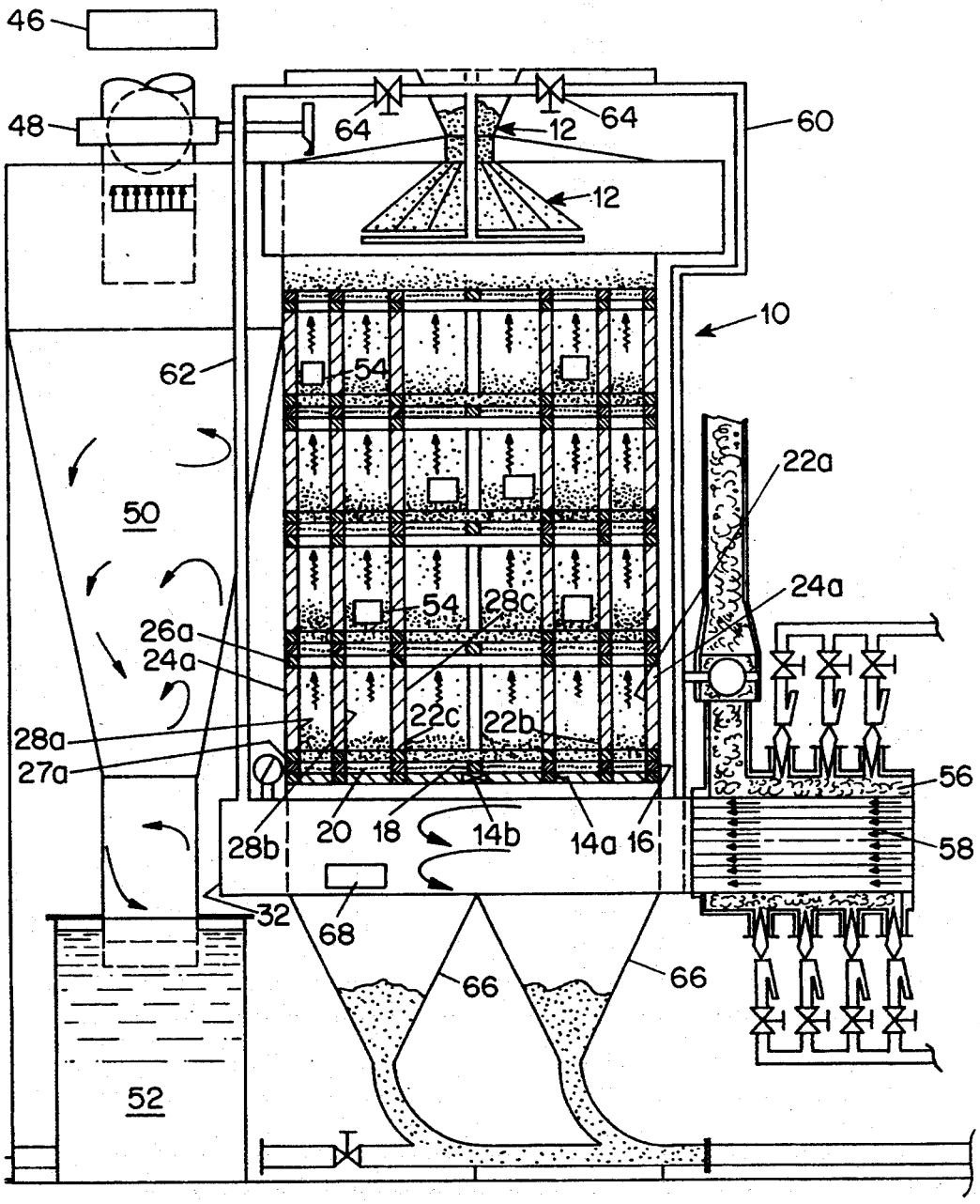
FIG. 1 is an elevational view, in cross-section, of an embodiment of the present invention.

As shown in FIG. 1, wet materials such as seeds to be dried are fed by way of a belt conveyor or other similar transport means into the top of a cylindrical housing by a distributor 12, which uniformly spreads the material over the entire cross-section of the housing by way of concentric distribution cones. The distribution cones made of bent thin solid steel plates, or of a mesh material with a relatively small clearance to keep the particles from crossing it while allowing air to pass. The wet materials may be fed into the distributor.

The dryer 10 has a plurality of vertically stacked drying stages, in this case 5 in number. At the base of the chamber are support cross bars 14*a*, 14*b* supporting the whole weight of the various stages, and at their ends the cross bars are welded to the body of the dryer at the side walls. The first drying stage rests on the cross bars 14*a*, 14*b*. The first drying stage comprises a horizontal ring 16 strengthened by welded crossbars 18 on top of which a horizontal mesh 20 is bolted. As shown in FIG. 2, on top of the mesh 20 is a set of three (3) concentric cages 22*a*, 22*b*, 22*c*, where each cage is arranged by welding vertical bars 24 to a upper ring 26*a* and lower ring 26*b* of same diameter, and by screwing or bolting a cylindrical meshes 28*a*, 28*b*, 28*c* to the inner surface of the respective cage. To maintain concentricity of the cages, radial arm spacers 30*a*, 30*b*, 30*c*, extend from each ring and are welded to the top and/or bottom rings. The ends of the radial arm spacers contact the inner surface of the next largest ring, or in the case of the largest ring, contact the inner cylindrical wall of the housing. The cages keep the seeds from migrating to the outer periphery of the drying stages. The other drying stages are similarly arranged and are stacked on top of each other. Such an arrangement provides flexibility in the number of drying stages desired, and also provides for easy disassembly of the unit for cleaning and maintenance.

The size of the openings in the mesh screens (sometimes called mesh clearance) should be greater than the largest size of the materials intended to be dried. For example, in the case of sesame seeds, the suggested mesh clearance or distance between adjacent wires is 4.5 or 5 mm (0.18 or 0.2") with the wire being 1–1.5 mm (0.04–0.06") thick. The typical length of sesame seeds is 2–3 mm while their width is 1–2 mm. This allows for even the largest seeds to be able to pass through the mesh screen openings. The mesh openings create a contraction in the cross-section about 50%, which results in about doubling the air speed through the mesh openings relative to the airflow in remaining part of the dryer.

Drying air, preferably heated, is introduced into the dryer housing by means of a lower spiral shaped inlet casing 32 which introduces air tangentially into the housing. As indicated by arrows, the air travels around the spiral shaped chamber which has a decreasing cross-sectional area toward the center. A number of pivotable gates are situated in openings in the interior wall of the inlet casing to allow for the air to pass into the bottom of the housing and to ensure that the air is distributed evenly within the dryer cross-section. These gates are similar to those described below in the upper spiral shaped chamber 40 and shown in FIG. 3. Opening and closing of the gates is controlled by a mechanical device actuated from outside, which allows for fixing the position of the gates.

A similar arrangement of an upper spiral shaped chamber 40 with pivotable gates 42 in respective wall openings is mounted above the uppermost drying stage for controlling the vertical air flow and for allowing for air that has passed through the housing to be removed. The air is evenly removed over the cross sectional area of the housing so that there will be a uniform upwardly vertical air flow within the housing. The air passes into the chamber of the outlet casing through the open gates and travels around the spiral shaped chamber to the exit which has a larger cross sectional area.

An extraction fan 46 and a damper 48 at the exit of the outlet chamber of the dryer create a subatmospheric pressure inside the dryer cylindrical housing to create and control the velocity of the upwardly vertical air flow. The damper 48 can be varied until the air speed at the mesh screen equals or is slightly greater than the suspension speed of the seeds. A water and trash separating cyclone 50 is provided and is dimensioned to provide separation of water and trash from the mixture, at only a moderate sacrifice of pressure loss. The trash is collected in collection bin 52.

Figure 5:
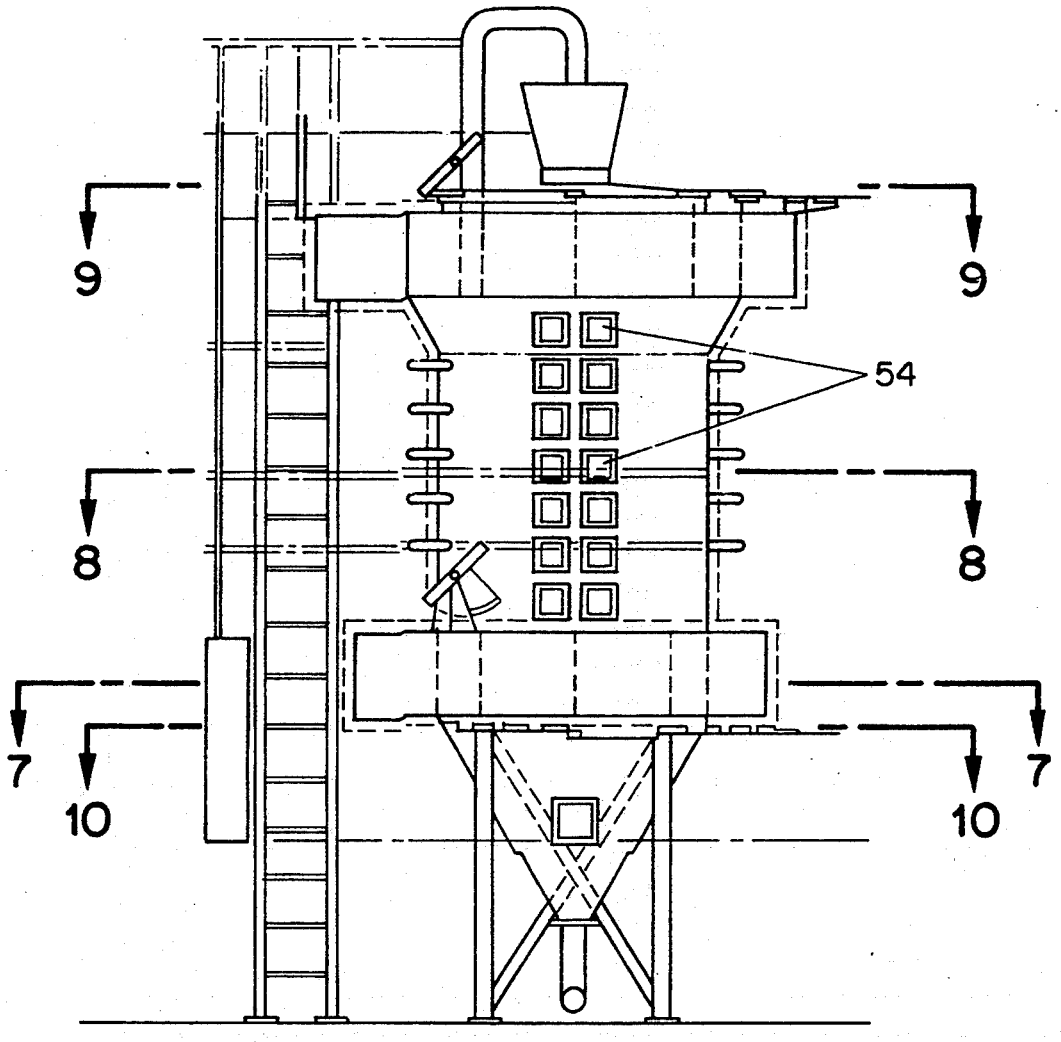
FIG. 5 is a side elevational view, of a modified embodiment of FIG. 4.
Figure 7:
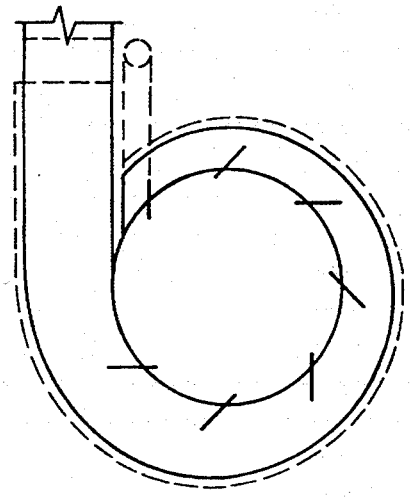
FIG. 7 is a cross-sectional view of the FIGS. 4 and 5 embodiment taken along lines C—C.

The progress of the drying can be monitored from any one of a number of built-in windows 54 in the housing side walls which enable viewing of the distribution of seeds in the various drying stages. Such windows 54 are also seen in FIG. 5. If the air speed at the mesh screen equals or is slightly higher than the suspension speed, the seeds will float on top of the mesh but will not pass through until enough seeds accumulate to provide sufficient weight or downward pressure to overcome the force of the upward air flow. Physical contact of the seeds with the hot mesh screens will provide additional heat transfer by conduction in addition to that of the connection created by the upward air flow, which also helps speed up the drying of the seeds. When the upward vertical air flow passes the seeds which are then suspended they are caused to rotate by the rotational component of the flow. This rotation of the seeds further delays their passing through the mesh screen openings, thus increasing the effective drying time of the seeds.

The air may be heated by gas or gas-oil combustion. In the former case the gas flame as well as the combustion smoke may be fed directly into the mouth of the inlet casing. Heating air in this way is thermally most efficient while still being relatively clean. However, if the materials to be dried must be perfectly clean or substantially pollution-free, indirect heating of the drying air may be accomplished by having an outer combustion chamber 56 which conducts heat by fins 58 into a clean air inlet providing air to the inlet casing 32. In the case of gas oil or fuel oil, an indirect fire and separate removal of the dirtier smokes is usually necessary. The thermal efficiency of the dryer will then also depend on how much combustion heat is lost in the smoke removal. The fuel supply preferably should be sufficient to heat the air up to around 350° C. (660° F.) at the inlet casing 32 so as to ensure that the temperature at outlet casing 40 remains high enough.

Two vertical pipes 60, 62 connecting the inlet casing to the exit of the material distributor cones 12 with valve controls 64, allow for dry hot air to be introduced at the top of the housing into the top drying stage in order to improve the drying effect at this stage.

When the materials have filtered through the mesh screens of the successive drying stages and have reached the bottom of the housing they are ready to be removed. The dry materials can be collected in one or more bottom cone or hoppers 66. A large window 68 is preferably provided to allow for good visibility and access to the collected materials. Removal of the seeds can also be accomplished by vacuum suction. When it is desirable to use a dryer that has a housing with a large diameter, the height of the dryer can be minimized by having a plurality, in this case four hoppers 66, two of which are shown in FIG. 1. The recommended mesh screen diameter and appropriate suspension speed for the seeds to be dried may be estimated and will be dependent upon the specific weight, size and shape of seed. Laboratory results are of course preferable to ensure the best accuracy. One advantage of this type of dryer is its simplicity, resulting in low costs of construction and of maintenance.

The air dryer does not require accessory equipment like the motor driven belt conveyors (conveyor dryer) or the large motor driven rotary drums (rotary dryer), as have been used in previous dryers and therefore reduces the effective costs of maintenance. The volume of the drying stages (effective drying zone) needed for a given seed or grain size and amount is probably smaller in this dryer than in any other dryer. The relatively small drying volume needed for an amount of materials will reduce the weight and cost of construction materials.

Keeping the seeds in suspension in a highly turbulent and hot air bed is a most effective drying method. Also the formation of layers of wet seeds which would lengthen effective drying time is unlikely. This air dryer also acts as an effective cleaning machine which removes or aspirates impure particles which are lighter than the seeds by these particles being entrained in the upward air flow which exits at the top of the dryer.

Figure 2:
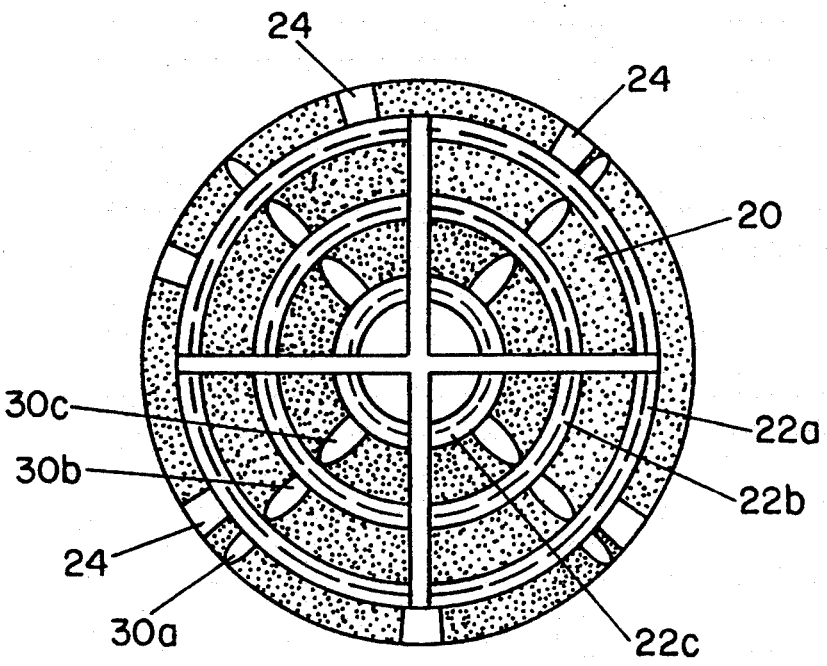
FIG. 2 is a top view of a drying stage of the present invention.
Figure 3:
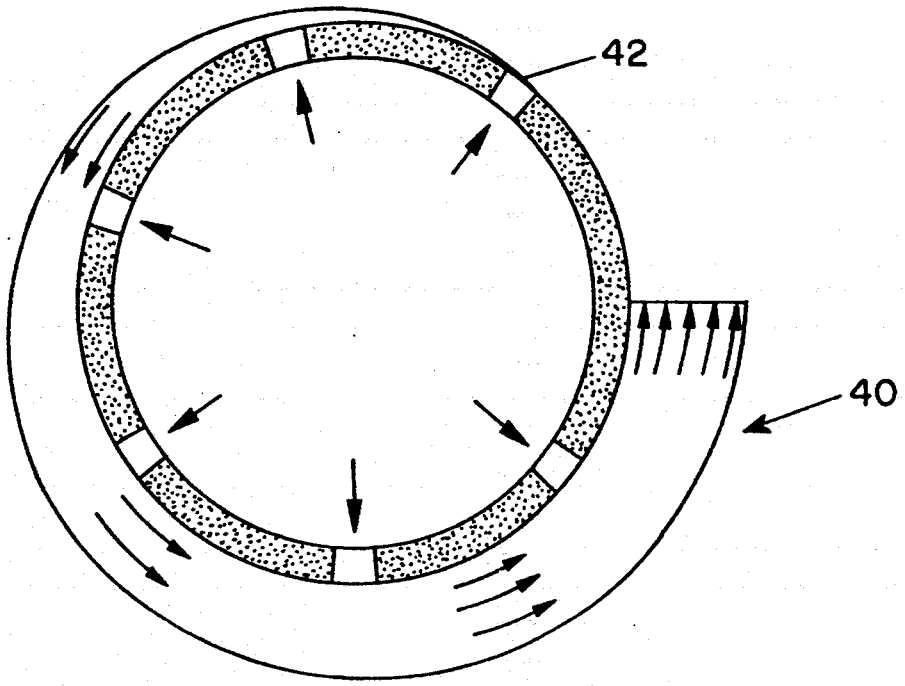
FIG. 3 is a top view of a spiral shaped air flow chamber at the top of the housing.

FIGS. 4–10 show a modified embodiment of FIGS. 1–3 incorporating many of the same features, with some different features. It should be understood that one may employ less than all of the features of the embodiment of FIGS. 4–10.

Figure 4:
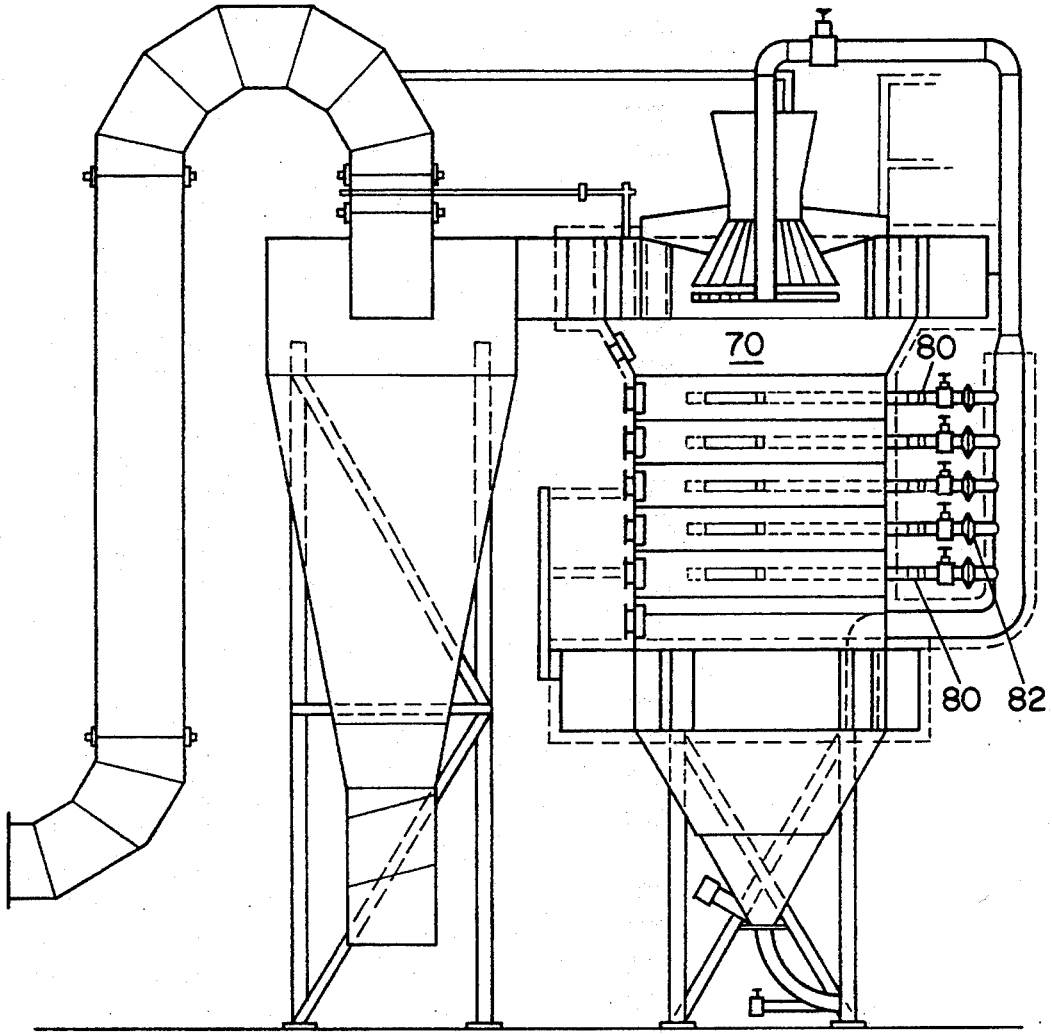
FIG. 4 is a front elevational view, in cross-section, of a modified embodiment of FIG. 1 according to the invention.
Figure 6:
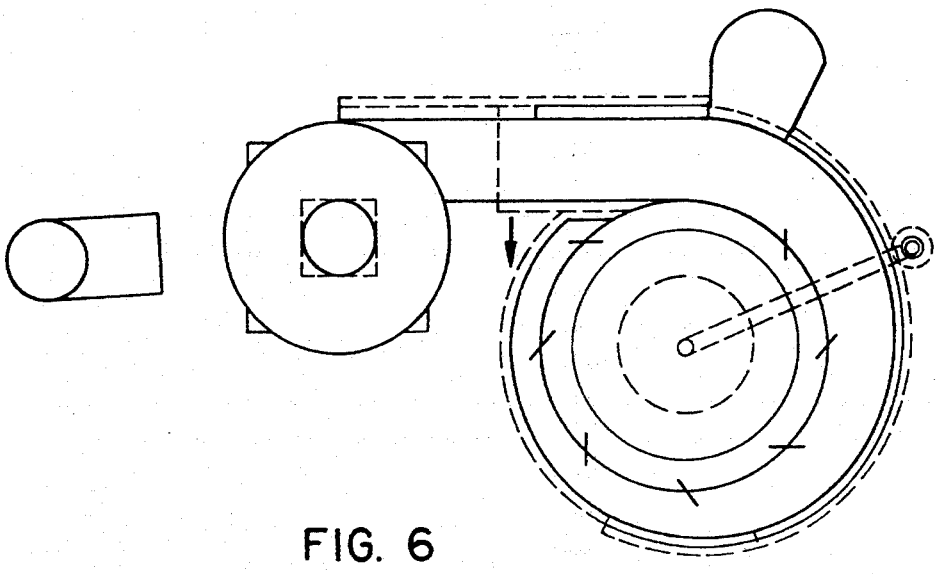
FIG. 6 is a cross-sectional view of the FIGS. 4 and 5 embodiment taken along lines B—B.

One of the features of this embodiment is that the cross-section at the top 70 of the cylindrical body containing the drying stages increases as one moves upwardly in a conical fashion (see FIGS. 4 and 5). This results in lower air velocities in the top region relative to the middle region of the body, and thus results in a better fall of particles from the distribution cones onto the first top meshed tray. This results also in an increase of the dimensions of the outlet-casing (spiral casing).

Figure 8:
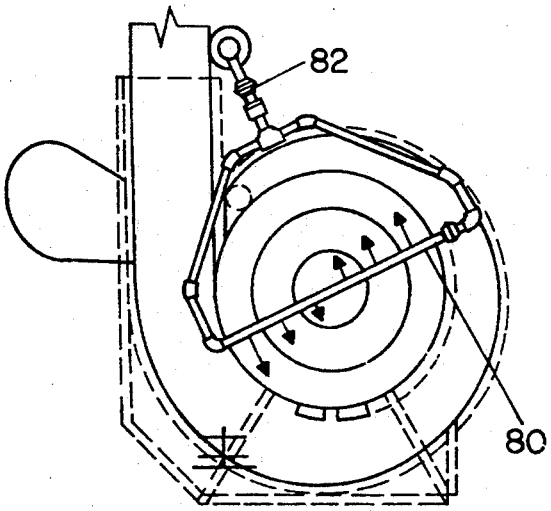
FIG. 8 is a cross-sectional view of the FIGS. 4 and 5 embodiment taken along lines E—E.
Figure 10:
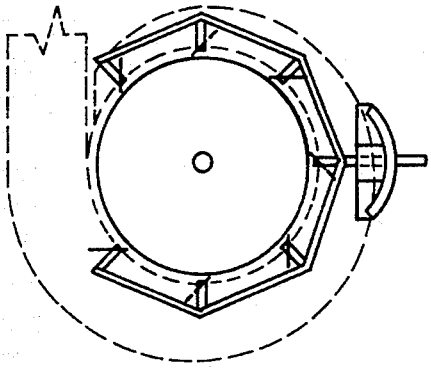
FIG. 10 is a cross-sectional view of the FIGS. 4 and 5 embodiment taken along lines G—G.
Figure 9:
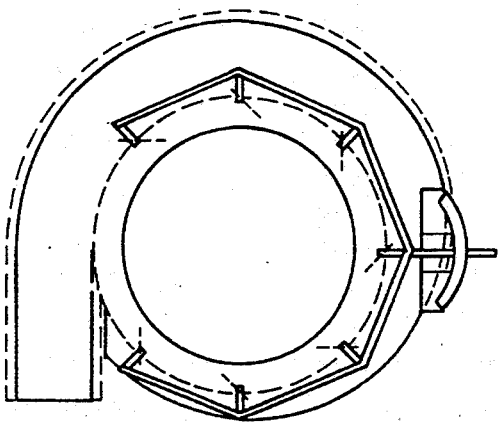
FIG. 9 is a cross-sectional view of the FIGS. 4 and 5 embodiment taken along lines F—F.

Another feature of this embodiment is the provision of transverse bypass pipes 80 to supply extra dry air to drying stages. Each pipe has a control valve 82 to regulate the flow rate which is extracted from the main vertical bypass feeding air into the top of the dryer. As best seen in FIG. 8, the transverse bypass pipes 80 have diametrical paths through the respective drying stages, and have air outlets to inject air in a rotating pattern as shown by the small arrows.

Instead of having static inner round walls for the two tangential inlet and outlet casings, where only the gates are rotated by an externally actuated lever, the inner round walls can be arranged to rotate like air driven turbines, whereby the gates serve as blades of a turbine. The angle can be fixed or adjustable, if desired, and the number of blades can be increased for increased turning efficiency. The cavity or space between the rotating round walls and the remaining static walls of the casings can be sealed by means of labyrinth seals.

Several different arrangements could be used to implement the rotating inner walls. On such possibility is to allow also rotation of the assembly of distribution cones (including the pipe at their center) and to use radial bars welded or screwed to this assembly as well as the rotating wall of the upper outlet casing. Provision of an upper bearing is required for this rotation around the symmetry axis of the dryer and to carry the weight of the rotating bodies. It is also possible to extend the pipe walls downward to support the rotating wall of the lower inlet casing. In view of the inertia of the rotating walls, the speed of rotation may be expected to be relatively low.

The above-described feature will provide an increased peripheral homogeneity of air flow at the outlet and inlet casing, respectively, in particular when air pulsations or waves occur inside the dryer as a consequence of a non-perfectly homogenous distribution of the particles. While the spiral shape of the casings certainly contributes to promote peripheral flow homogeneity, it may not be sufficient in various applications.

Figure 11:
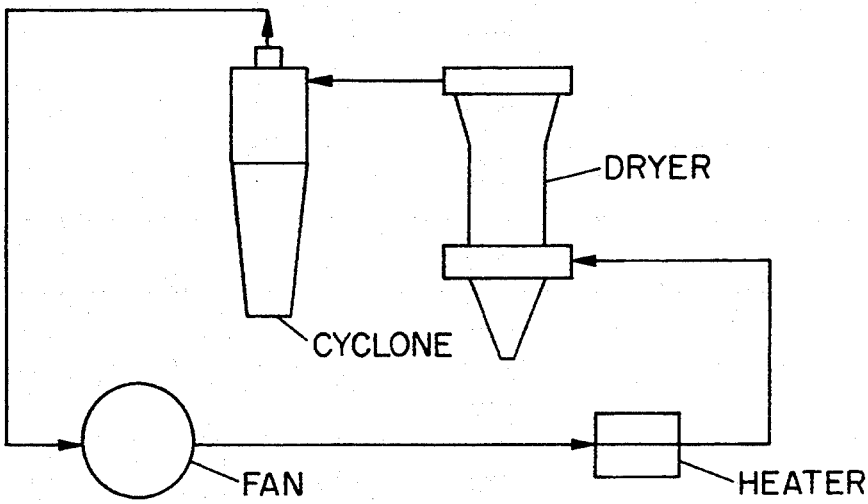
FIG. 11 shows a schematic for recycling the process air.

FIG. 11 shows an arrangement for recycling the air, which is especially useful in localities which have laws limiting the amount of drying or cleaning air which can be fan-extracted into the surrounding atmosphere.

While the preferred embodiment have been described in connection with particle drying, as mentioned above the apparatus and method according to the invention encompasses broadly effecting chemical and/or physical reactions by means of solid/gas contact.

It will be evident to those skilled in the art that the invention is not limited to the details of the foregoing illustrated embodiment and that the present invention may be embodied in other specific forms without departing from the spirit or essential attributes thereof. The present embodiment is therefore to be considered in all respects as illustrative and not restrictive, the scope of the invention being indicated by the appended claims rather than the foregoing description, and all changes which come within the meaning and range of equivalency of the claims are therefore intended to be embraced therein.

What is claimed is:

1. An air dryer for drying particle formed materials comprising:

a housing having a top, bottom and substantially parallel side walls and defining an interior having a substantially uniform cross-section in the vertical direction;

means for introducing materials to be dried into said housing;

at least one drying stage having mesh means defining openings greater than the largest size particle of the material to be dried, said drying stage located between the top and bottom walls and extending to the side walls of said housing;

means for introducing air into each drying stage;

air flow means for extracting air from the top of said housing and for a subatmospheric pressure and a rotating and upwardly vertical flow of air within said housing having a velocity within the mesh openings at least equal to the speed at which the material to be dried remains suspended, and for suspending the particles above the mesh means to provide sufficient weight or downward pressure for the particles to overcome the upward air flow, pass through the openings in the mesh means and fall to the bottom of said housing.

2. An air dryer according to claim 1, wherein said means for introducing materials comprises a plurality of concentric distribution cones to distribute said materials over a horizontal plane of an uppermost drying stage, and wherein the cones are made of mesh material having a clearance smaller than the particle material to be dried.

3. An air dryer according to claim 1, wherein said means for introducing materials comprises a distributor at the top of the housing and wherein the housing increases in diameter at the top.

4. An air dryer according to claim 1, wherein said means for introducing air into each drying stage introduces air in a rotating pattern.

5. A method for drying particle formed materials comprising the steps of:

loading particle formed materials to be dried into the top of a housing of a dryer having a top, bottom and substantially parallel side walls to define an interior having a substantially uniform cross-section in the vertical direction, and at least one drying stage having a mesh means defining openings slightly greater than the largest size particles to be dried, said drying stage located between the top and bottom walls and extending to the side walls of the housing; and introducing air into each drying stage; and extracting air from the top the housing to create a subatmospheric pressure and a rotating and upward air flow in said housing having a velocity within the mesh openings at least equal to the suspension speed of particles to be dried, whereby particles to be dried will remain suspended until enough particles accumulate above the mesh means to provide sufficient weight or downward pressure for the particles to overcome the upward air flow, pass through the openings in the mesh means and fall to the bottom of said housing.

6. An apparatus for effecting chemical and physical reactions by means of a solid/gas contact comprising:

a housing having a top, bottom and substantially parallel side walls and defining an interior having a substantially uniform cross-section in the vertical direction;

means for introducing solid particle materials having a defined particle size into said housing;

at least one interaction stage having mesh means defining openings slightly greater than the particle size of the material, said interaction stage located between the top and bottom walls and extending to the side walls of said housing;

gas flow means for extracting gas from the top of said housing and for creating a subatmospheric pressure and a rotating and upwardly vertical flow of gas within said housing having a velocity within the mesh openings at least equal to the speed at which the material remains suspended, and for suspending the particles above the mesh means until enough particles accumulate above the mesh means to provide sufficient weight or downward pressure for the particles to overcome the upward gas flow, pass through the openings in the mesh means and fall to the bottom of said housing.

7. A method for effecting chemical and physical reactions by means of a solid/gas contact comprising:

loading particle formed solid materials having a defined particle size into the top of a housing having a top, bottom and substantially parallel side walls to define an interior having a substantially uniform cross-section in the vertical direction, and at least one interaction stage having a mesh means defining openings slightly greater than the particle size of the material, said interaction stage located between the top and bottom walls and extending to the side walls of the housing; and extracting gas from the top of the housing and for creating a subatmosphere pressure and a rotating and an upward gas flow in said housing having a velocity within the mesh openings at least equal to the suspension speed of particles, to suspend the particles until enough particles accumulate above the mesh means to provide sufficient weight or downward pressure for the particles to overcome the upward gas flow, pass through the openings in the mesh means and fall to the bottom of said housing.

* * * * *